US006827028B1

(12) United States Patent
Callaway

(10) Patent No.: US 6,827,028 B1
(45) Date of Patent: Dec. 7, 2004

(54) COLLAPSIBLE SUPPORT

(76) Inventor: E. Pryor Callaway, 399 10th St., #2, Brooklyn, NY (US) 11215

( * ) Notice: Subject to any disclaimer, the term of this patent is extended or adjusted under 35 U.S.C. 154(b) by 0 days.

(21) Appl. No.: 10/316,042

(22) Filed: Dec. 11, 2002

(51) Int. Cl.[7] ..... A47B 3/06

(52) U.S. Cl. ..... 108/158.12; 108/157.1; 108/157.16; 108/159.1; 312/257.1; 312/265.5; 312/265.6

(58) Field of Search ..... 220/4.28, 4.29, 220/4.3, 4.31, 4.32, 4.33, 4.38, 666, 682; 248/165, 188, 460, 461; 108/156, 157.16, 158.12, 159, FOR 103, FOR 104, 17, 157.15, 157.17, 157.18, 153.1, 157.1, 25, 26, 49, 101; 312/257.1, 265.1, 265.2, 265.3, 265.4, 265.5, 265.6

(56) References Cited

U.S. PATENT DOCUMENTS

| | | | | | |
|---|---|---|---|---|---|
| 2,119,799 | A | * | 6/1938 | Sivey | 126/9 R |
| 2,414,332 | A | * | 1/1947 | Roumillat | 206/165 |
| 2,546,812 | A | | 3/1951 | Anderson | |
| 2,615,771 | A | * | 10/1952 | Curtis | 108/159 |
| 2,701,009 | A | | 2/1955 | Richard | |
| 2,911,265 | A | * | 11/1959 | Hannah | 182/186.5 |
| 3,410,441 | A | * | 11/1968 | Rhyne | 220/4.28 |
| 3,644,008 | A | * | 2/1972 | Overby | 312/107 |
| 3,866,549 | A | * | 2/1975 | Berton | 108/158.12 |
| 3,885,845 | A | * | 5/1975 | Krieks | 312/265 |
| 4,191,113 | A | | 3/1980 | Hogberg | |
| 4,232,916 | A | * | 11/1980 | Correia | 312/107 |
| 4,519,318 | A | * | 5/1985 | Weldon-Ming | 108/33 |
| 5,244,271 | A | * | 9/1993 | Hackwood et al. | 312/313 |
| 5,644,995 | A | * | 7/1997 | Gurwell et al. | 108/188 |
| 5,765,922 | A | | 6/1998 | Hsia | |
| 5,887,741 | A | * | 3/1999 | Chiang | 220/4.31 |
| 5,893,617 | A | * | 4/1999 | Lee | 312/263 |
| 5,921,631 | A | | 7/1999 | Bush | |
| 6,036,270 | A | | 3/2000 | Bufalini | |
| 6,109,695 | A | | 8/2000 | Kahwaji | |
| 6,619,749 | B2 | * | 9/2003 | Willy | 297/440.13 |
| 6,702,375 | B1 | * | 3/2004 | Laskowski et al. | 297/188.07 |

FOREIGN PATENT DOCUMENTS

| | | | |
|---|---|---|---|
| DE | 31 21 265 | | 12/1982 |
| GB | 2 188 230 | | 9/1987 |
| JP | 410165229 | A * | 6/1998 |

* cited by examiner

*Primary Examiner*—Anita King
*Assistant Examiner*—Jon Szumny
(74) *Attorney, Agent, or Firm*—Steven P. Arnheim; Shaw Pittman LLP

(57) ABSTRACT

A collapsible support includes at least one leg that can be stored in a cavity and at least one substantially smooth surface when assembled in a deployed condition. The collapsible support can also include at least one substantially smooth surface when assembled in a collapsed or stored condition. The collapsible support includes unique provisions for associating the legs with a base in both the collapsed condition and the deployed condition.

12 Claims, 12 Drawing Sheets

COLLAPSIBLE SUPPORT

BACKGROUND

1. Field of the Invention

The present invention relates to a support of any kind, including a stool, chair, table, or bench. More particularly, the present invention is directed to a collapsible support.

2. Background of the Invention

Support devices come in many different types and styles. Occasionally, a support device will include provisions that permit the device to be folded or otherwise collapsed. Some collapsible supports include Anderson, U.S. Pat. No. 2,546,812; Kahwaji, U.S. Pat. No. 6,109,695; Bufalini, U.S. Pat. No. 6,036,270; Bush, U.S. Pat. No. 5,921,631; Hsia, U.S. Pat. No. 5,765,922; Hogberg, U.S. Pat. No. 4,191,113; and Richard, U.S. Pat. No. 2,701,009.

However, the devices disclosed in the related art can be cumbersome and difficult to assemble. Many require the use of pins, wedges, and other small fasteners to complete assembly. These small parts increase the complexity and difficulty of assembly. In addition, these small parts can break or become lost.

The related devices have not been aesthetically pleasing in either the assembled, deployed position or the collapsed position, much less both. Related devices have also required separate carriers, bags, or other accessories to properly hold and transport the device when the device has been disassembled.

While there have been attempts to improve collapsible supports, none of the related devices provide an aesthetically pleasing device that is simple to assemble and disassemble, sturdy, and easy to transport.

SUMMARY OF THE INVENTION

The present invention is directed to a collapsible support comprising a base including a first end and a second end. The first end includes a first side and the second end includes a second side. A cavity is formed between the first side and the second side. A first leg is disposed within the cavity during a collapsed position.

In another aspect, the invention includes a second leg disposed within the cavity during a collapsed position.

In another aspect, the invention includes at least one substantially smooth surface while the collapsible support is in the collapsed position.

In another aspect, the invention includes exterior surfaces that are substantially smooth while the collapsible support is in the collapsed position.

In another aspect, the invention includes a lateral tenon on the first leg.

In another aspect, the invention includes a first leg with a projecting tenon.

In another aspect, the invention provides a collapsible support including a base with a first end and a second end, and a first leg having a first surface and a second surface. The first surface of the first leg is disposed adjacent and opposite the base in a collapsed position. The first surface of the first leg faces outward in a deployed position.

In another aspect, the invention provides a second leg that includes a first surface and a second surface, wherein the first surface of the second leg is proximate the base in the collapsed position and wherein the first surface of the second leg faces outwards in the deployed position.

In another aspect, the invention includes a first leg with a lateral tenon configured to engage a slot formed on the base in the collapsed position.

In another aspect, the invention includes a lateral tenon of the first leg that is configured to engage a base hole formed on the base in the deployed position.

In another aspect, the invention includes a second leg with a lateral tenon configured to engage a slot formed on the base in the collapsed position.

In another aspect, the invention includes a lateral tenon of the second leg that is configured to engage a base hole formed on the base in the deployed position.

In another aspect, the invention includes a base with a first base projection configured to engage a leg hole disposed on the first leg when the first leg is in the collapsed position.

In another aspect, the invention includes a first leg that is received in a first region disposed between the first base projection and a first side portion.

In another aspect, the invention includes a base with a second base projection configured to engage a leg hole disposed on a second leg when the second leg is in the collapsed position.

In another aspect, the invention includes a second leg that is received in a second region disposed between the second base projection and a second side portion.

In another aspect, the invention provides a collapsible support including a base and a first leg. The base has a first side portion and a second side portion. The first side portion is disposed at a first end of the base and has a first end connected to the base and a second end spaced from the base. The second end of the first side portion has an outer surface. The first leg includes an upper side and a lower side disposed adjacent to the base in the collapsed position. The upper side of the first leg forms a continuous surface with the outer surface of the first side portion when the first leg is in the collapsed position.

In another aspect, the invention includes a collapsible support in which the second side portion is disposed at a second end of the base and has a first end connected to the base and a second end portion spaced from the base. The second end portion of the second side portion has an outer surface. A second leg includes an upper side and a lower side disposed adjacent to the base in the collapsed position. The upper side of the second leg forms a continuous surface with the outer surface of the second side portion when the second leg is in the collapsed position.

In another aspect, the invention includes a hole in the base.

In another aspect, the invention includes first and second legs with voids that correspond with the hole disposed in the base.

Additional features and advantages of the invention will be set forth in the description that follows, and in part will be apparent from the description, or may be learned by practice of the invention. The objectives and advantages of the invention will be realized and attained by the structure and steps particularly pointed out in the written description, the claims, and the drawings.

DETAILED DESCRIPTION OF THE PREFERRED EMBODIMENTS

Figure 1:
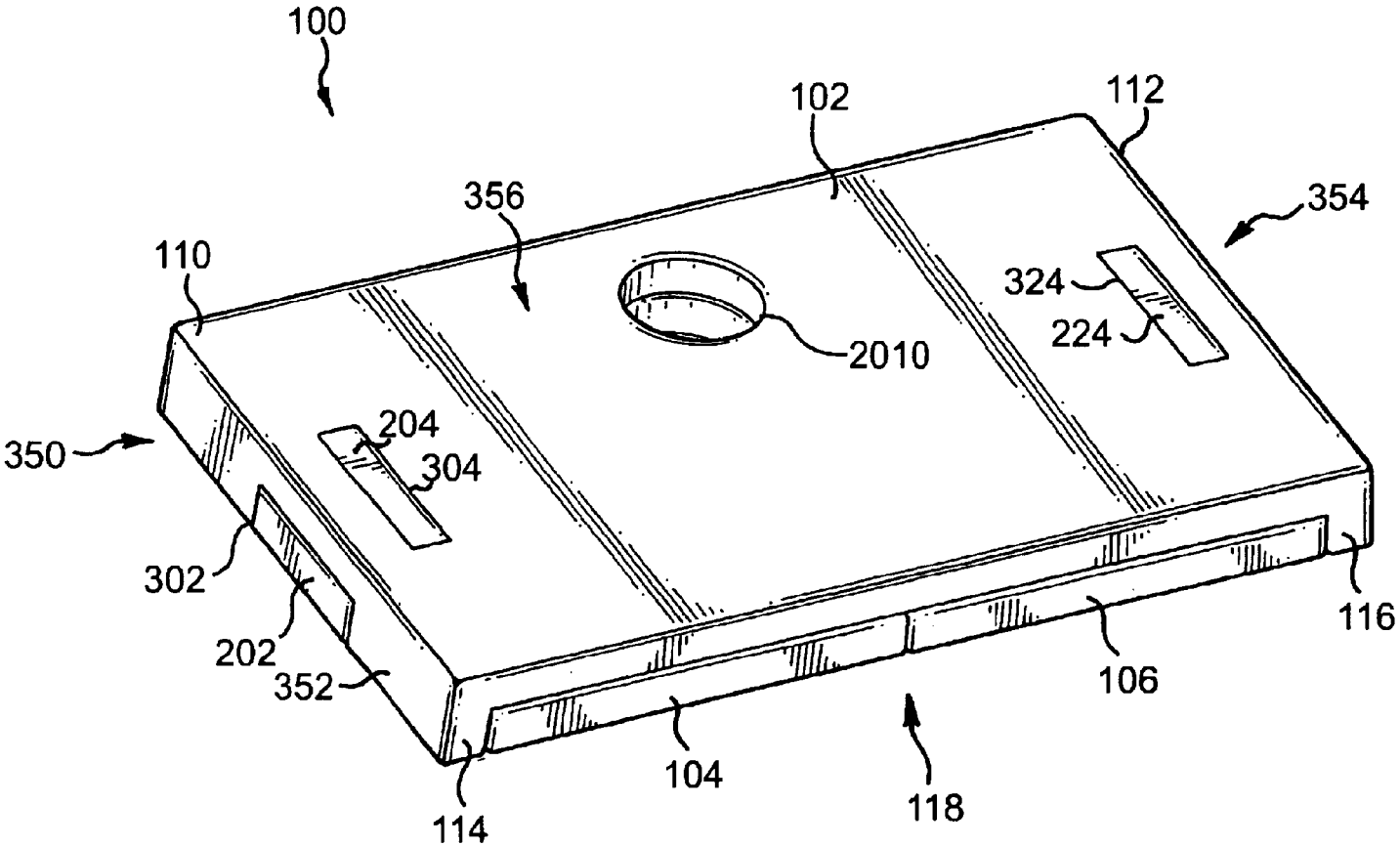
FIG. 1 is an isometric view of a preferred embodiment of a collapsible support in a collapsed or stored condition of the present invention.

FIG. 1 is an isometric view of a preferred embodiment of a collapsible support 100 in accordance with the present invention. FIG. 1 shows an embodiment of a collapsible support 100 in a closed or non-use position. Collapsible support 100 includes a base 102, a first leg 104, and a second leg 106. In the collapsed arrangement, first leg 104 is associated with first end 110 of base 102 and second leg 106 is associated with second end 112 of base 102.

Preferably, first end 110 includes a first side portion 114 and second end 112 includes a second side portion 116. Preferably, first side portion 114 extends downward from the end of first end 110, and likewise, second side portion 116 extends from the end of second end 112. First and second side portions 114 and 116 form a cavity 118 between the first and second side portions 114 and 116. Preferably, in the collapsed arrangement, first leg 104 and second leg 106 are disposed within cavity 118. In an exemplary embodiment, first and second legs 104 and 106 fit snuggly within cavity 118 and respective surfaces of the first leg 104 and the second leg 106 correspond with respective surfaces of cavity 118.

Figure 2:
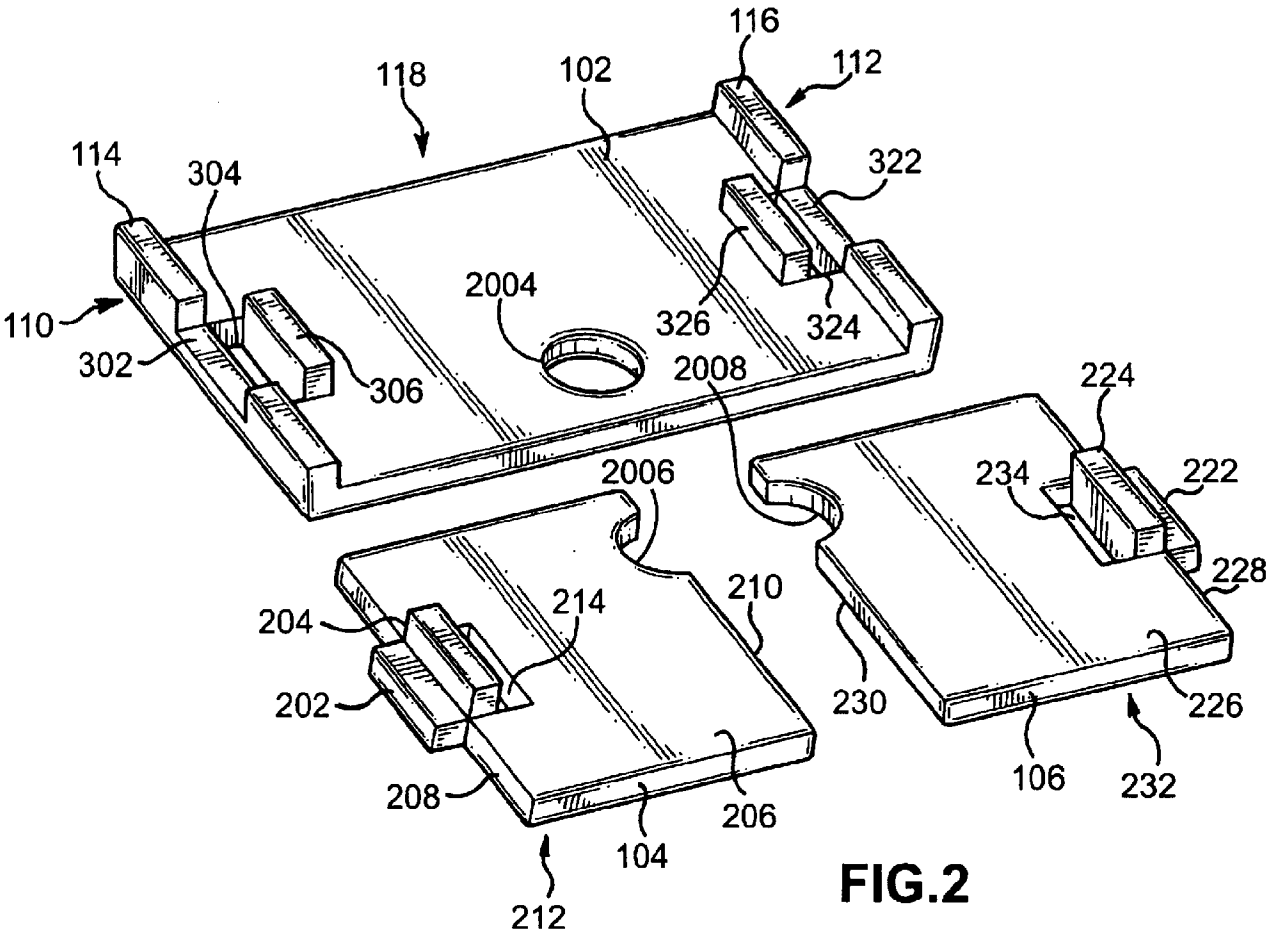
FIG. 2 is an isometric view of a preferred embodiment of a collapsible support in a disassembled condition of the present invention.
Figure 5:
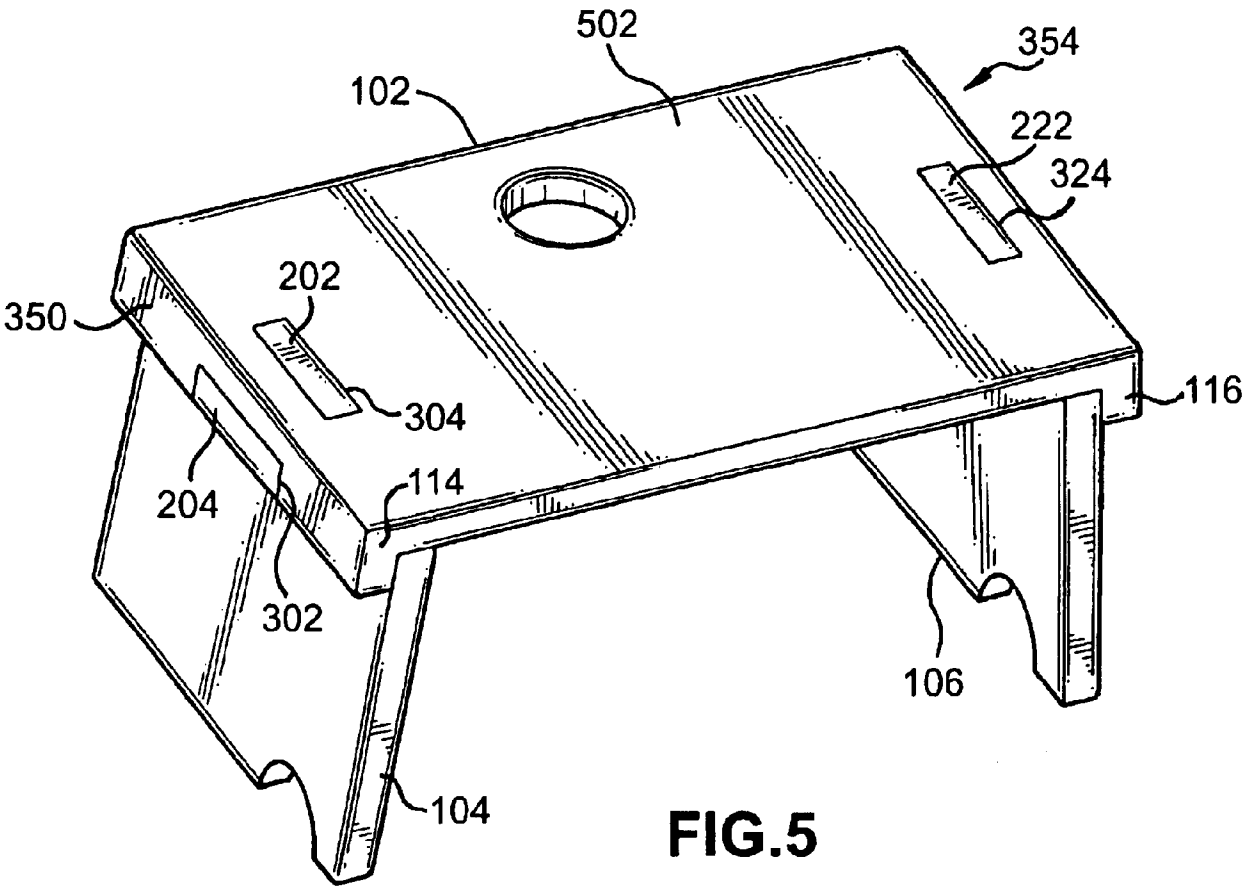
FIG. 5 is an isometric view of a preferred embodiment of a collapsible support in an assembled condition of the present invention.

Collapsible support 100 can be altered from the closed, stored, or non-use position shown in FIG. 2 to an open or deployed position, as shown in FIG. 5. To achieve this, the legs 104 and 106 are first removed from cavity 118. FIG. 2 shows an embodiment of collapsible support 100 after the legs 104 and 106 have been removed from cavity 118 and placed next to base 102. From this view, other features of collapsible support 100 can be seen.

In addition to the corresponding surfaces between the legs and the base, collapsible support 100 can also include provisions that permit the easy and sturdy assembly and disassembly of the legs 104 and 106 with base 102.

Additional details of collapsible support 100 can be seen in FIG. 2, which is a disassembled view. Referring to FIG. 2, first leg 104 preferably includes a lateral tenon 202 and a projecting tenon 204. Lateral tenon 202 is an extension of an upper end 208 of first leg 104. Projecting tenon 204 preferably extends in a direction approximately normal to first surface 206 of first leg 104. The angle of projecting tenon 204 with respect to first surface 206 can vary depending on the desired design of collapsible support 100, as discussed in greater detail below.

First surface 206 preferably faces cavity 118 when first leg 104 is in its stored position. Opposite first surface 206 is second surface 212. First leg 104 also includes a lower end 210 that is opposite upper end 208. First leg 104 can also include leg hole 214.

When first leg 104 is stored in cavity 118, various elements of first leg 104 are designed to engage various elements of base 102. Lateral tenon 202 is designed to engage slot 302 of base 102, projecting tenon 204 is designed to engage first base hole 304, and leg hole 214 is designed to receive first base projection 306.

Preferably, second leg 106 includes features similar to first leg 104 and the portion of cavity 118 designed to receive second leg 106 includes similar features as the portion of cavity 118 designed to receive first leg 104.

Second leg 106 preferably includes a lateral tenon 222 and a projecting tenon 224. Lateral tenon 222 is an extension of an upper end 228 of second leg 106. Projecting tenon 224 preferably extends in a direction approximately normal to first surface 226 of second leg 106. The angle of projecting tenon 224 with respect to first surface 226 can vary depending on the desired design of collapsible support 100, as discussed in greater detail below.

First surface 226 preferably faces cavity 118 when second leg 106 is in its stored position. Opposite first surface 226 is second surface 232. Second leg 106 also includes a lower end 230 that is opposite upper end 228. Second leg 106 can also include leg hole 234.

When second leg 106 is stored in cavity 118, various elements of second leg 106 are designed to engage various elements of base 102. Lateral tenon 222 is designed to engage second slot 322 of base 102, projecting tenon 224 is designed to engage second base hole 324, and leg hole 234 is designed to receive second base projection 326.

With all of the various elements engaging one another, collapsible support 100 attains at least one smooth outer surface when assembled in the collapsed or stored position, as shown in FIG. 1. Preferably, more than one smooth surface is achieved, and in the exemplary embodiment shown in FIG. 1, all six sides of collapsible support 100 are generally smooth when first and second legs 104 and 106 are stored in cavity 118.

The term "smooth" means that the surface or side has a generally continuous or even surface, and can include minor depressions or projections of various members and/or features. In some cases, these minor surface irregularities are caused by manufacturing tolerances, part mismatch, and/or assembly mismatch.

Returning to FIG. 1, after the legs 104 and 106 are assembled in the collapsed or stored condition, at least one surface is substantially smooth. Preferably, more than one surface is substantially smooth, and in the exemplary embodiment shown in FIG. 1, all of the surfaces are substantially smooth.

Left end surface 350, proximate first end 110, is substantially smooth. Side surface 352 of first side portion 114 and the outer surface of lateral tenon 202 of first leg 104 form a substantially smooth left end surface 350. As discussed above, slot 302 formed on first side portion 114 is designed to receive lateral tenon 202 and assists in producing a substantially smooth left end surface 350.

Preferably, a substantially smooth left end surface 350 is achieved by carefully designing the length of lateral tenon 202. Preferably, the length of lateral tenon 202 is such that the end of lateral tenon 202 is approximately co-planar with side surface 352 of first side portion 114. The length of lateral tenon 202 can also be described as being roughly equal to the thickness of first side portion 114.

Preferably, right end surface 354 includes features, similar to those found on left end surface 350, that provide a substantially smooth right end surface 354.

Upper surface 356 of base 102 can also be designed to have a substantially smooth surface. First base hole 304 is adapted to receive projecting tenon 204 of first leg 104. Preferably, the upper surface of projecting tenon 204 is substantially co-planar with upper surface 356 of base 102. This can be accomplished by insuring that the length of projecting tenon 204 is substantially equal to the local thickness of base 102. Second base hole 324 and projecting tenon 224 of second leg 106 can be similarly designed so that second end 112 of base 102 has a substantially smooth upper surface 356.

Figure 3:
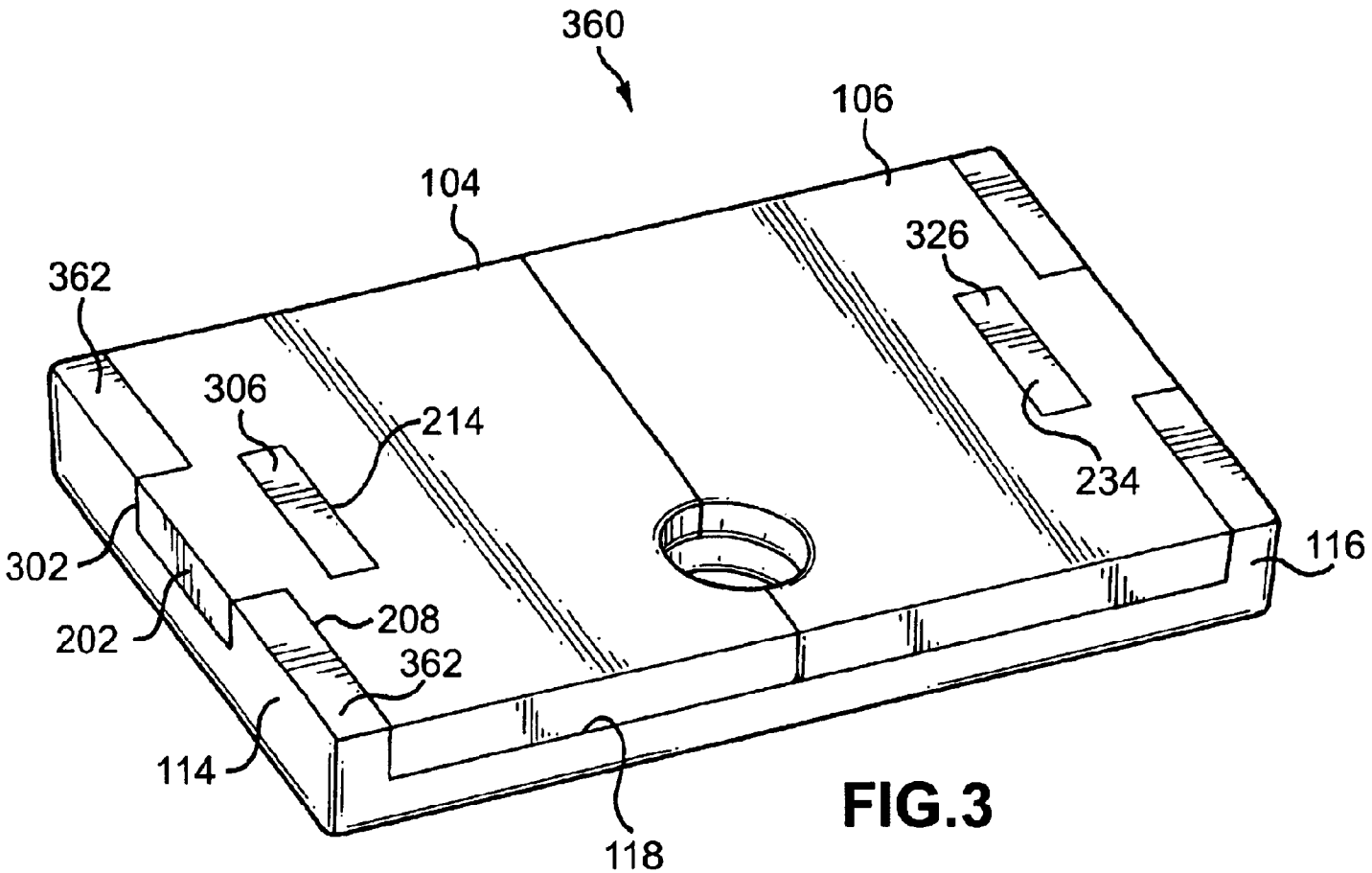
FIG. 3 is an isometric view of a preferred embodiment of a collapsible support in a collapsed or stored condition of the present invention.

FIG. 3 shows the underside or lower surface 360 of collapsible support 100 in its assembled and collapsed or stored position. Preferably, lower surface 360 is also designed to be substantially smooth when legs 104 and 106 are stored in cavity 118. Collapsible support 100 includes several provisions to achieve this substantially smooth lower surface 360.

The thickness of first leg 104 and second leg 106 is substantially equal to the height of first end portion 114 and second end portion 116. Also, the heights of first base projection 306 and second base projection 326 are substantially equal to the thickness of first leg 104 and second leg 106. Because of this arrangement, the upper surfaces of first base projection 306 and second base projection 326 are generally flush with respective surfaces of the first leg 104 and the second leg 106.

First slot 302 is designed to provide a substantially smooth lower surface 360. The depth of first slot 302 such that when lateral tenon 202 is placed in first slot 302, a surface of lateral tenon 202 is flush with the lower surface 362 of first side portion 114. Another way to express the design of first slot 302 is to observe that the depth of first slot 302 is equal to the thickness of lateral tenon 202. Also, it can be observed that the bottom surface of slot 302 is co-planar with the bottom surface of cavity 118. Preferably, second slot 322 is designed in a way similar to first slot 302.

Figure 4:
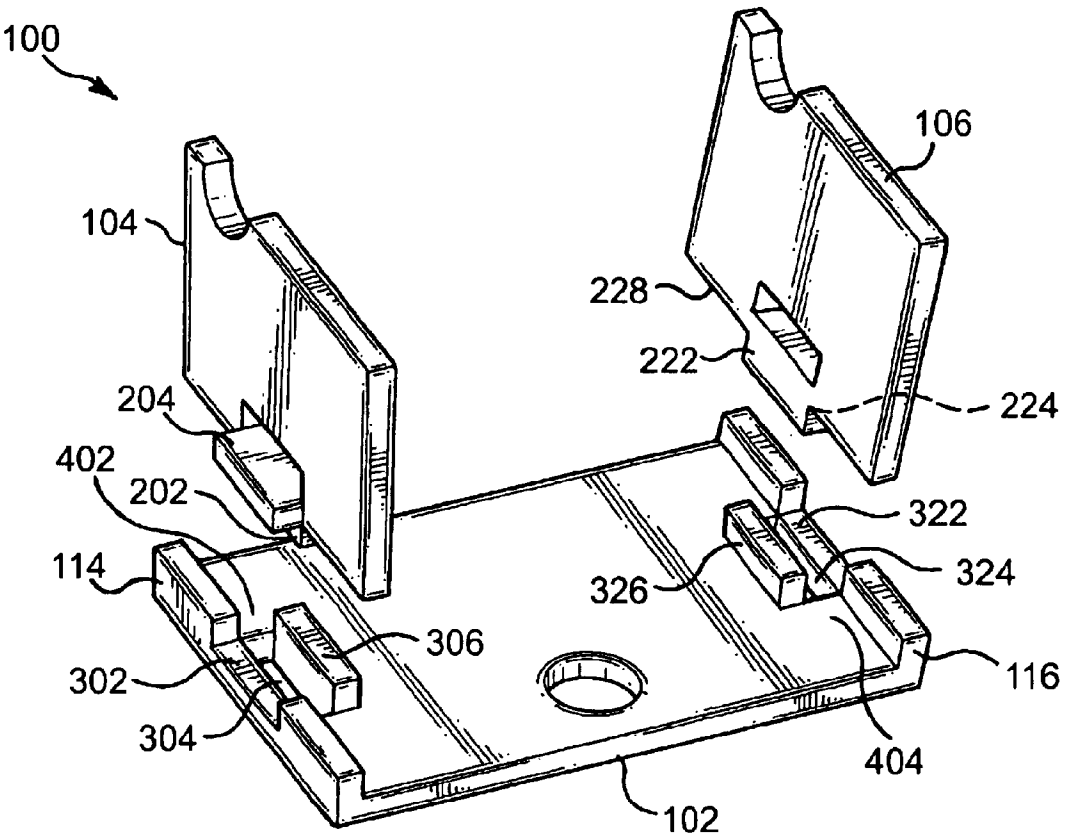
FIG. 4 is an exploded isometric view of a preferred embodiment of a collapsible support in a disassembled condition of the present invention.

The legs 104 and 106, after being removed from cavity 118, can be reattached to base 102 in an assembled, deployed arrangement, as shown in FIG. 4, which is an exploded isometric view of collapsible support 100.

First leg 104 engages one of the ends and second leg 106 engages the other end. Preferably, first leg engages first end 110 and second leg engages second end 112. However, the legs are interchangeable and the legs 104 and 106 can engage either end.

As shown in FIG. 4, lateral tenon 202 of first leg 104 engages first base hole 304 and projecting tenon 204 engages slot 302. Preferably, first leg 104 is received in a first region 402 disposed between first side portion 114 and first base projection 306. First side portion 114 and first base projection 306 are preferably disposed on opposite sides of first leg 104 and can provide additional support to first leg 104 and prevent first leg 104 from wobbling.

Preferably, upper end 118 of first leg 104 is disposed proximate to base 102 when first leg 104 is installed in the deployed condition. In some cases, upper end 118 contacts base 102 when first leg 104 is installed in the deployed condition.

Second leg 106 is associated with base 102 in a manner similar to first leg 104. Lateral tenon 222 of second 106 engages second base hole 324 and projecting tenon 224 engages second slot 322. Preferably, second leg 106 is received in a second region 404 disposed between second side portion 116 and second base projection 326. Second side portion 116 and second base projection 326 are preferably disposed on opposite sides of second leg 106 and can provide additional support to second leg 106 and prevent second leg 106 from wobbling.

Preferably, upper end 228 of second leg 106 is disposed proximate to base 102 when second leg 106 is installed in the deployed condition. In some cases, upper end 228 contacts base 102 when second leg 106 is installed in the deployed condition.

FIG. 5 shows collapsible support 100 in the assembled and deployed position. Preferably, when collapsible support 100 is in the deployed condition, many of the surfaces are substantially smooth.

Upper surface 502 of base 102 is preferably substantially smooth. As shown in FIG. 5, lateral tenon 202 of first leg 104 extends through first base hole 304 and lateral tenon 222 of second leg 116 extends through second base hole 324. Preferably, the two lateral tenons 202 and 222 are sized so that the upper surfaces of those tenons are approximately flush with upper surface 502 of base 102.

Left end surface 350 of first side portion 114 is also preferably designed to be substantially smooth in the deployed condition. Preferably, projecting tenon 204 of first leg 104 is designed to fit snuggly into first slot 302. Preferably, projecting tenon 204 is sized so that its outer surface is approximately flush with left end surface 350 of first side portion 114. In this way, left end surface 350 achieves a substantially smooth surface. Preferably, right end surface 354 is also substantially smooth and includes features similar to those associated with left end surface 350.

As noted above, and as shown in some of the drawings, legs 104 and 106 can be angled with respect to base 102 when legs 104 and 106 are associated with base 102 in the deployed condition. Although other arrangements may be used, the following features that provide this angular arrangement are preferred.

Figure 6:
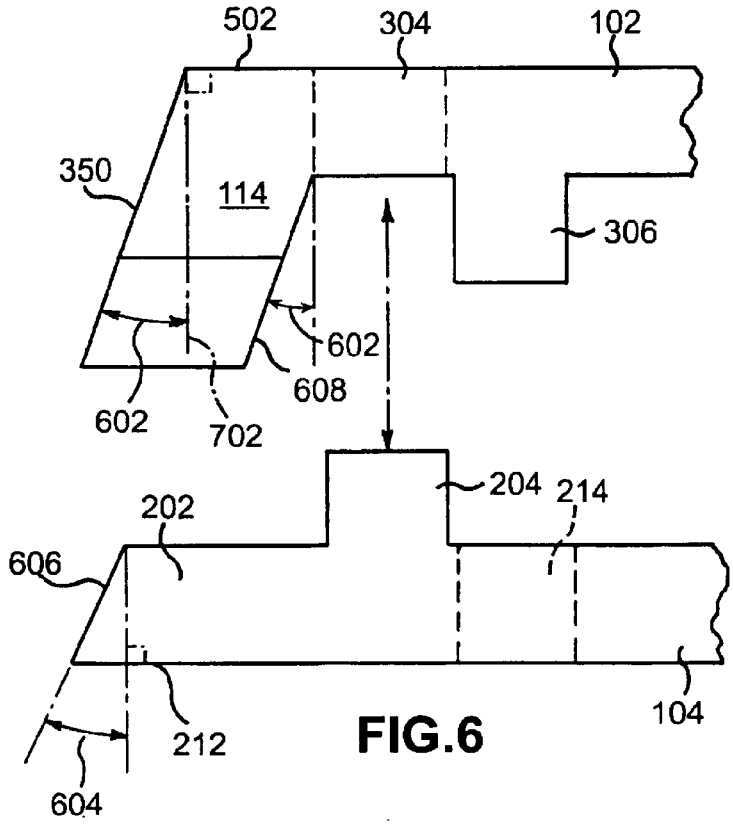
FIG. 6 is an enlarged, exploded, cross-sectional view of a preferred embodiment of a collapsible support in a disassembled condition of the present invention.

Referring to FIG. 6, which is an enlarged, exploded cross-sectional view, left end surface 350 of base 102 is angled by an angle 602 with respect to vertical line 702. Left inner surface 608 is preferably parallel with left end surface 350, and can also be angled by angle 602 with respect to vertical line 702. Likewise, end surface 606 of tenon 202 is angled with respect to vertical line 702. Preferably, when first leg 104 is assembled with base 102 in the stored or collapsed position, end surface 606 of tenon 202 matches or corresponds with left end surface 350 of base 102. In order to accomplish this match, angle 602 is generally equivalent to angle 604.

Figure 7:
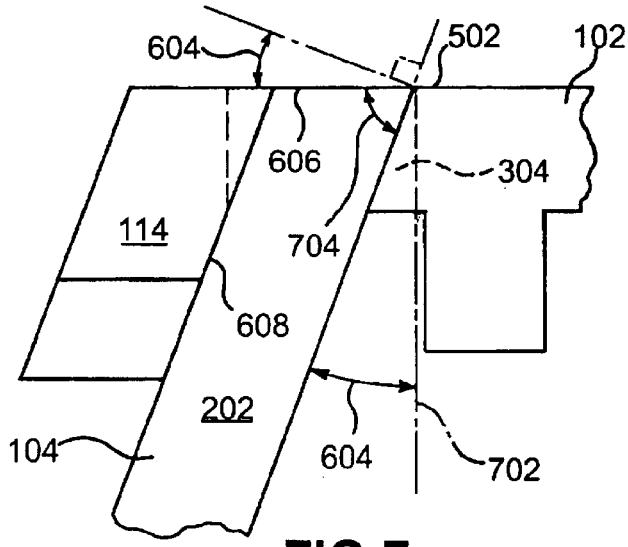
FIG. 7 is an enlarged, cross-sectional view of a preferred embodiment of a collapsible support in an assembled condition of the present invention.

Referring to FIG. 7, which is an enlarged cross-sectional view of collapsible support 100 in the assembled, deployed position, lateral tenon 202 of first leg 104 is inserted into first base hole 304. Note that because of the geometry and angle of first end portion 114, left inner surface 608 and/or the shape of first base hole 304, first leg 104 is angled with respect to base 102. This angle between base 102 and first leg 104 can be observed using hypothetical vertical line 702. Also, because end surface 606 of tenon 202 is angled by an angle 604, end surface 606 of tenon 202 is flush with upper surface 502 of base 102. In this way, an angled leg, as well as a substantially smooth upper surface can be provided to collapsible support 100.

Figure 8:
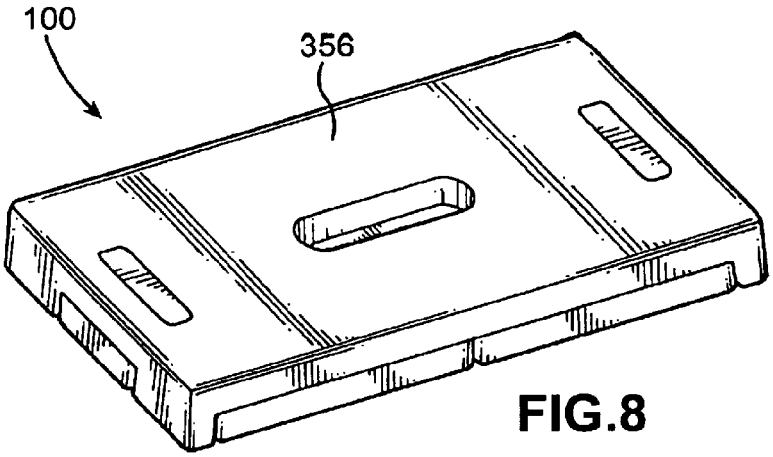
FIGS. 8–14 are isometric views of a preferred embodiment of a collapsible support, showing a preferred series of steps to transition a collapsible support from a collapsed or stored position, as shown in FIG. 8, to a deployed position, as shown in FIG. 14.
Figure 12:
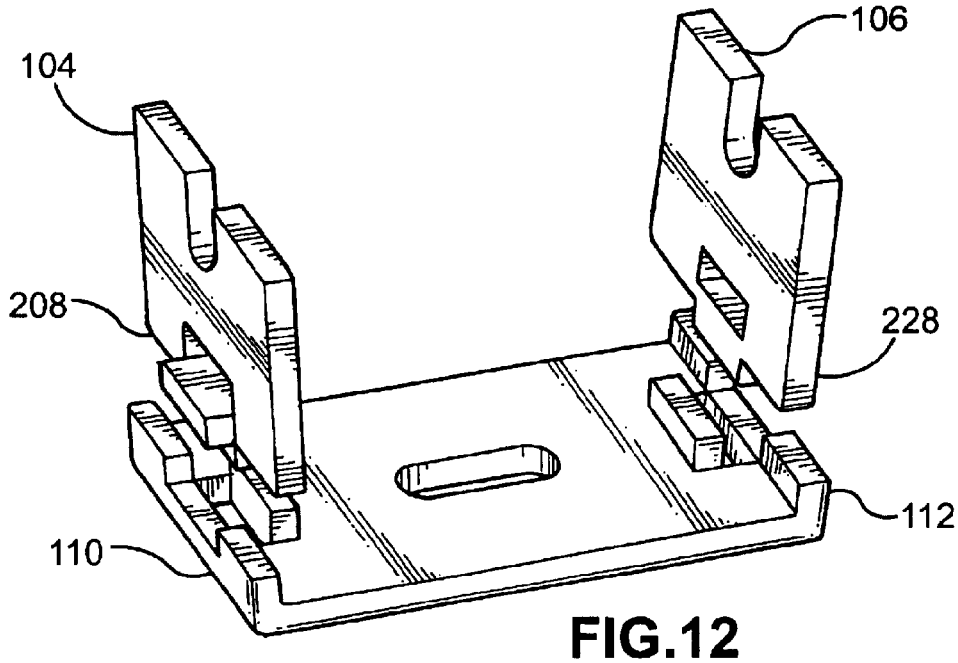
Figure 13:
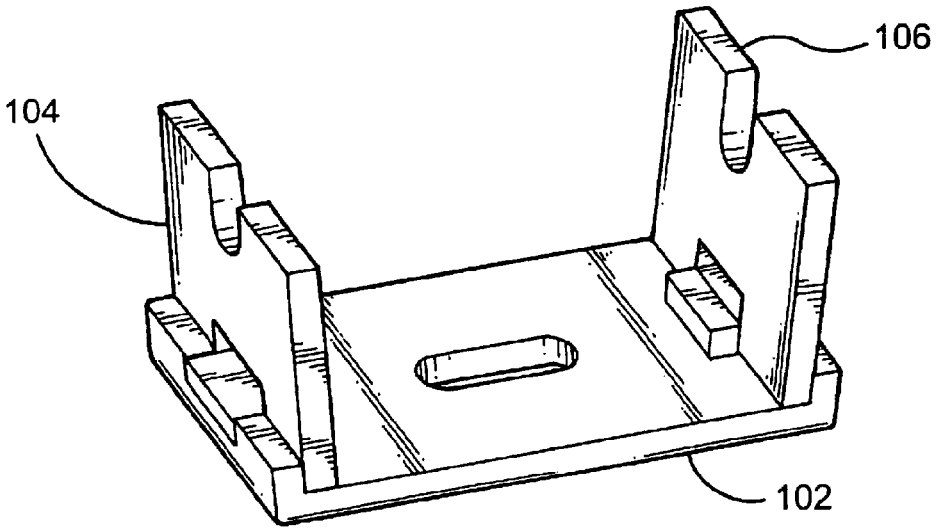
Figure 14:
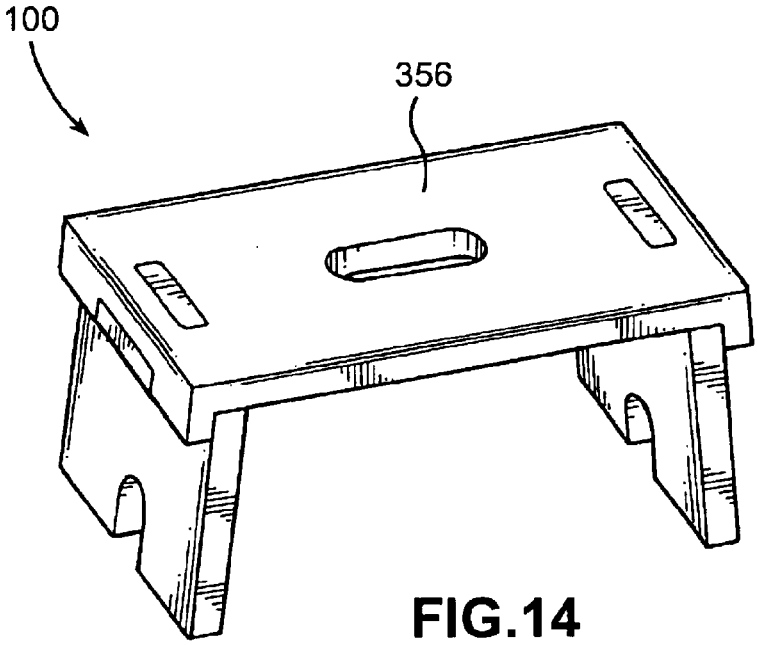

FIGS. 8–14 show a preferred series of steps to transition collapsible support 100 from a collapsed or stored position, shown in FIG. 8, to a deployed position, as shown in FIG. 14.

Figure 9:
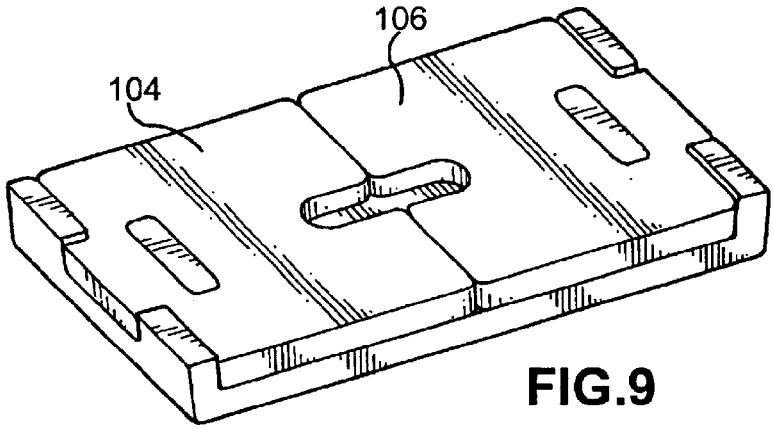

The conversion steps begin with upper surface 356 of collapsible support 100 facing upwards. To commence conversion, collapsible support 100 is preferably flipped upside down as shown in FIG. 9.

Figure 10:
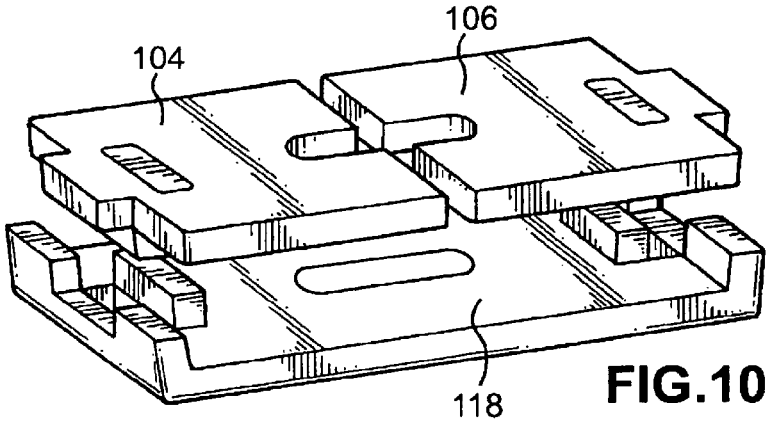

With first leg 104 and second leg 106 now facing upwards, those legs 104 and 106 are preferably removed from cavity 118 as shown in FIG. 10. The legs 104 and 106 are then preferably rotated. Preferably, first leg 104 is rotated about upper end 208 and second leg 106 is rotated about upper end 228. After this is done, upper end 208 of first leg 104 is disposed proximate first end 110 of base 102 and upper end 228 of second leg 106 is disposed proximate second end 112 of base 102.

Figure 11:
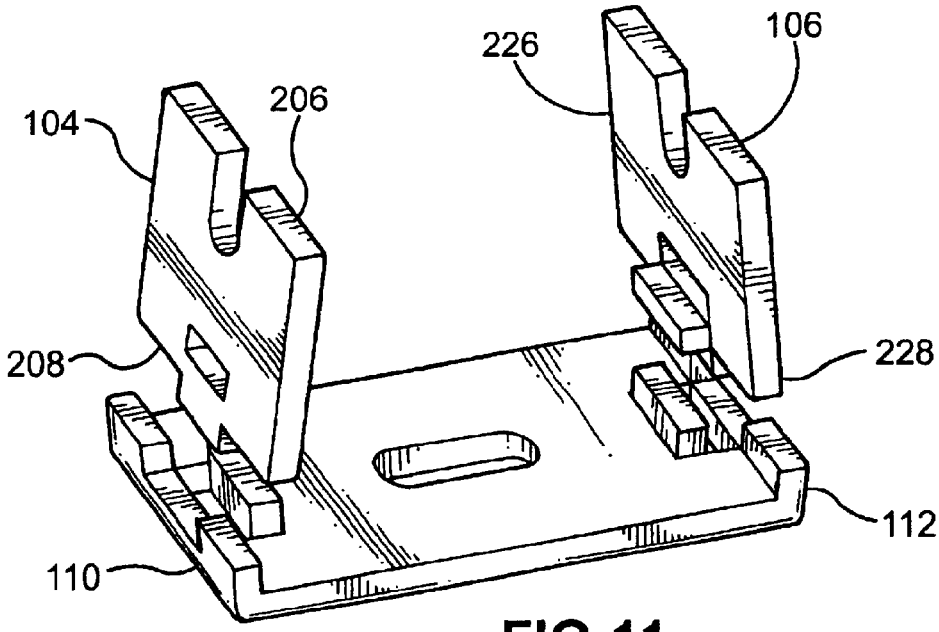

After first leg 104 and second leg 106 have been rotated about their respective upper portions, 208 and 228, as shown in FIG. 11, the legs 104 and 106 cannot successfully engage first end 110 and second end 112, respectively, of base 102 because the various slots, holes and tenons do not properly align. Notice that in the position shown in FIG. 11, first surface 206 of first leg 104 is facing inwards, and first surface 226 of second leg 106 is facing inwards.

In order to complete assembly, legs 104 and 106 are rotated about a vertical axis so that first surface 206 of first leg 104 is facing outwards and first surface 226 of second leg 106 is also facing outwards. This position is shown in FIG. 12. FIG. 12 is similar to FIG. 4, and the legs 104 and 106 are now properly aligned with the features of base 102. As discussed above, this permits engagement of the various provisions of legs 104 and 106 with the various respective provisions of base 102 and permits base 102 to receive legs 104 and 106. This assembled position is shown in FIG. 13. After the legs 104 and 106 have been associated with base 102, collapsible support 100 can then be flipped over so that upper surface 356 is facing upwards. Upper surface 356 can then be used as a support surface. There are many different uses of collapsible support 100. Some examples include: foot stool, stool, seat, table, chair, and/or step. Many other uses are also possible.

In some embodiments, the configuration shown in FIG. 14 can be enlarged to produce supports that are appropriately sized to serve as seats, tables, chairs, steps, or other devices. However, different configurations can also be used to produce larger supports.

Figure 15:
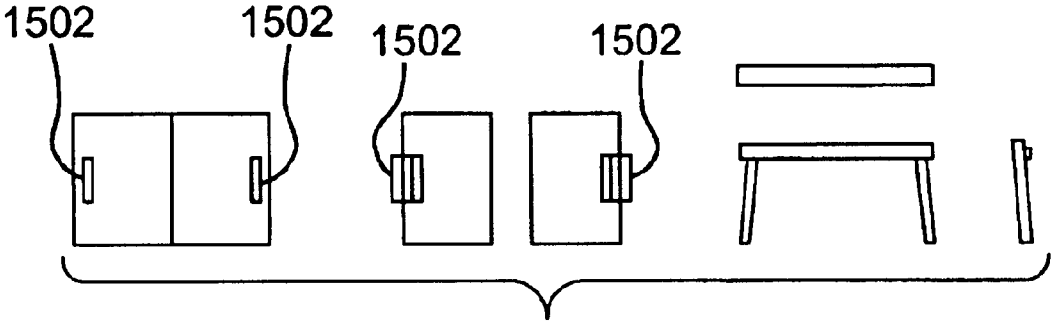
FIG. 15 is a schematic multi-view diagram showing a top view of an exemplary collapsed support, top views of associated legs, and side views of assembled and disassembled configurations, according to an embodiment of the present invention.

FIG. 15 is a schematic multi-view diagram showing a top view of a collapsed support, top views of associated legs, and side views of assembled and disassembled configurations. The configuration shown in FIG. 15 is similar to the embodiment shown in FIGS. 1–14. In this configuration, a single connection arrangement is used. A "connection arrangement" refers to the various tenons, slots, and holes that are used to associate a leg with a base in both the collapsed condition and the assembled condition. As shown in FIG. 15, a single connection arrangement 1502 is used.

Figure 16:
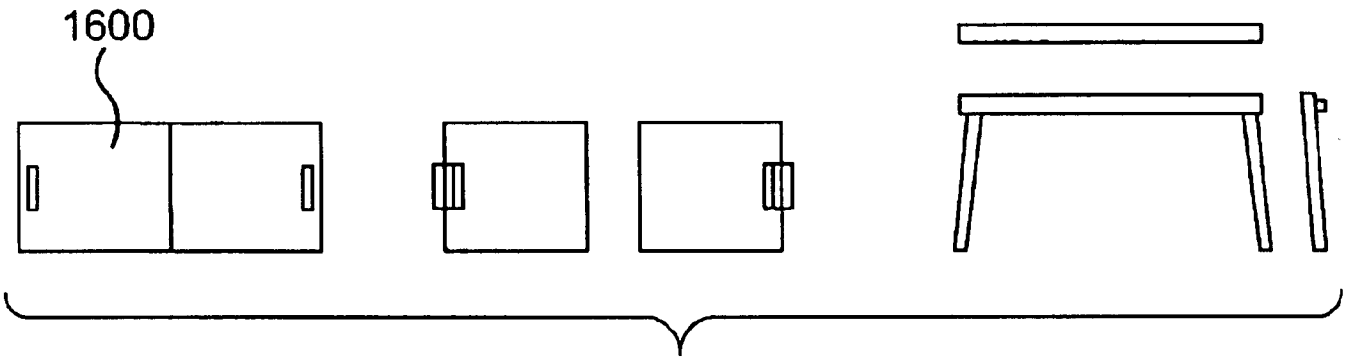
FIG. 16 is a schematic multi-view diagram showing a top view of another exemplary collapsed support, top views of associated legs, and side views of assembled and disassembled configurations, according to another embodiment of the present invention.

It is possible to change the proportions of a collapsible support. FIG. 16 shows a configuration with different proportions than that of FIG. 15. The collapsible support 1600 of FIG. 16 is elongated when compared to the configuration shown in FIG. 15.

Figure 17:
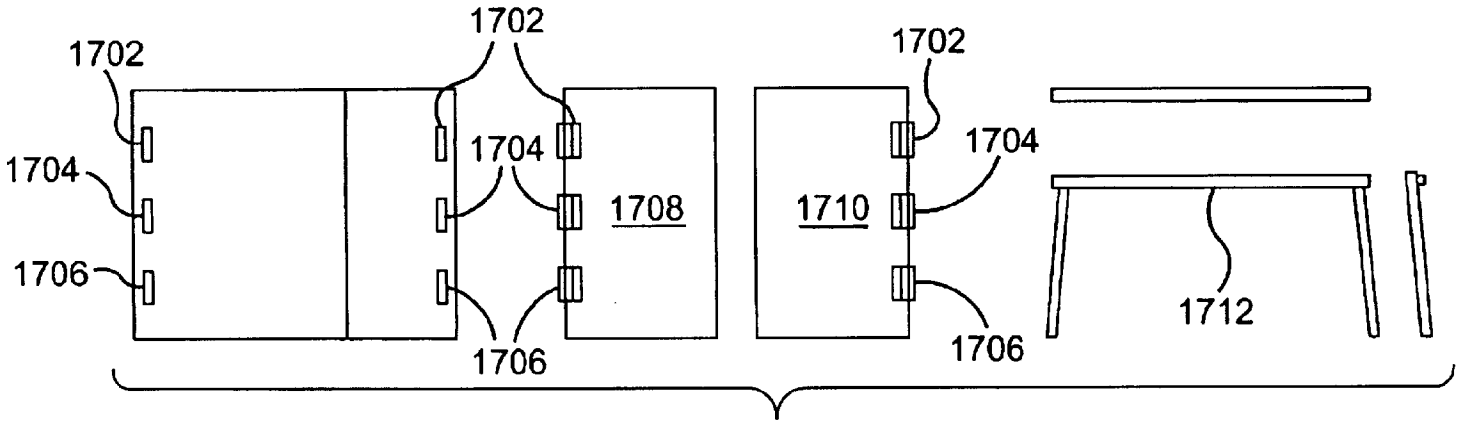
FIG. 17 is a schematic multi-view diagram of a preferred embodiment of a collapsible support having three connection arrangements, showing a top view of the collapsible support in a collapsed configuration, top views of associated legs, and side views of assembled and disassembled configurations.
Figure 18:
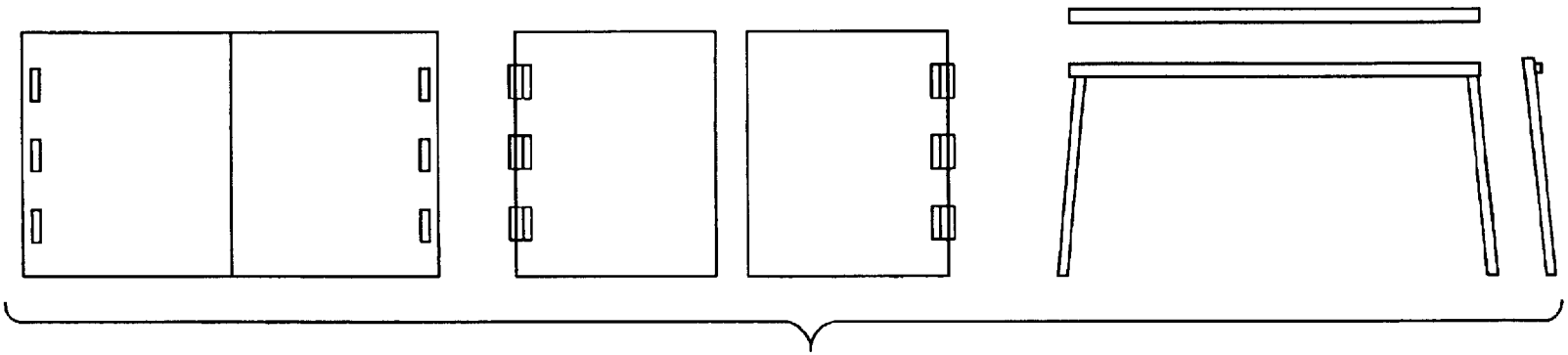
FIG. 18 is a schematic multi-view diagram of another preferred embodiment of a collapsible support having three connection arrangements, showing a top view of the collapsible support in a collapsed configuration, top views of associated legs, and side views of assembled and disassembled configurations.

It is also possible to vary the number of connection arrangements used in a collapsible support. One, two, three, or many connection arrangements can be used. In the embodiments shown in FIG. 17, three connection arrangements 1702, 1704, and 1706 are used. These additional connection arrangements provide additional strength and stability to the joint between the legs 1708 and 1710 and the base 1712. FIG. 18 shows a collapsible support having three connection arrangements that include different proportions than that of the FIG. 17 embodiment. The larger embodiment shown in FIG. 18 is suitable for use as a table or other work surface.

FIGS. 1–14 show an embodiment of a collapsible support with a single round hole. However, it is possible to provide different types of holes and different numbers of holes through the collapsible support.

Figure 19:
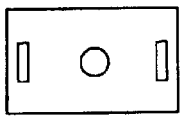
FIG. 19 is a schematic diagram showing a top view of an exemplary collapsible support with a centered, round hole, according to an embodiment of the present invention.
Figure 20:
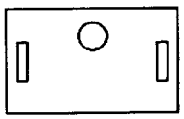
FIG. 20 is a schematic diagram showing a top view of an exemplary collapsible support with a round hole that is located horizontally centered, but vertically off-center, according to an embodiment of the present invention.
Figure 21:
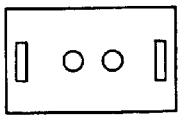
FIG. 21 is a schematic diagram showing a top view of an exemplary collapsible support with two centered, round holes, according to an embodiment of the present invention.
Figure 22:
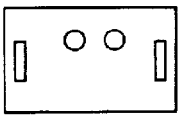
FIG. 22 is a schematic diagram showing a top view of an exemplary collapsible support with two horizontally centered holes that are vertically off-center, according to an embodiment of the present invention.
Figure 23:
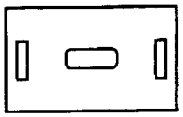
FIG. 23 is a schematic diagram showing a top view of an exemplary collapsible support with a centered racetrack shaped hole, according to an embodiment of the present invention.
Figure 24:
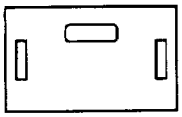
FIG. 24 is a schematic diagram showing a top view of an exemplary collapsible support with a race track shaped hold hole that is vertically off-center, according to an embodiment of the present invention.
Figure 25:
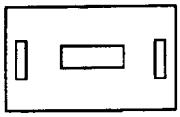
FIG. 25 is a schematic diagram showing a top view of an exemplary collapsible support with a centered rectangular hole, according to an embodiment of the present invention.
Figure 26:
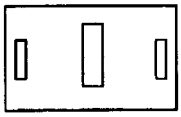
FIG. 26 is a schematic diagram showing a top view of an exemplary collapsible support with a centered rectangular hole that has a major axis that is perpendicular to the major axis of the collapsible support, according to an embodiment of the present invention.
Figure 27:
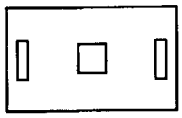
FIG. 27 is a schematic diagram showing a top view of an exemplary collapsible support with a centered square hole, according to an embodiment of the present invention.
Figure 28:
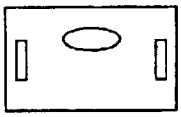
FIG. 28 is a schematic diagram showing a top view of an exemplary collapsible support with an oval hole that is vertically off-center, according to an embodiment of the present invention.
Figure 29:
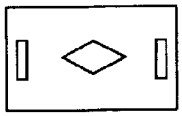
FIG. 29 is a schematic diagram showing a top view of an exemplary collapsible support with a centered, diamond shaped hole with a major axis parallel to the major axis of the collapsible support, according to an embodiment of the present invention.
Figure 30:
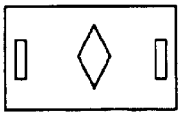
FIG. 30 is a schematic diagram showing a top view of an exemplary collapsible support with a centered, diamond shaped hole with a major axis perpendicular to the major axis of the collapsible support, according to an embodiment of the present invention.
Figure 31:
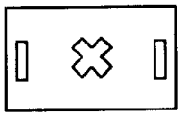
FIG. 31 is a schematic diagram showing a top view of an exemplary collapsible support with a cross-shaped hole that is obliquely disposed relative to the collapsible-support, according to an embodiment of the present invention.
Figure 32:
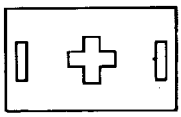
FIG. 32 is a schematic diagram showing a top view of an exemplary collapsible support with a cross-shaped hole that is normally disposed to the collapsible support, according to an embodiment of the present invention.
Figure 33:
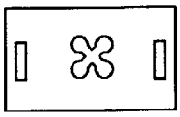
FIG. 33 is a schematic diagram showing a top view of an exemplary collapsible support with a puffy cross-shaped or clover shaped hole obliquely disposed relative to the collapsible support, according to an embodiment of the present invention.
Figure 34:
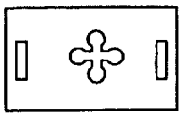
FIG. 34 is a schematic diagram showing a top view of an exemplary collapsible support with a puffy cross-shaped or clover shaped hole normally disposed relative to the collapsible support, according to an embodiment of the present invention.
Figure 35:
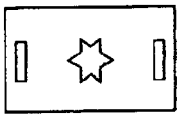
FIG. 35 is a schematic diagram showing a top view of an exemplary collapsible support with a six-pointed star shaped hole, according to an embodiment of the present invention.
Figure 36:
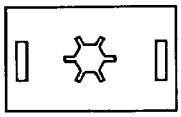
FIG. 36 is a schematic diagram showing a top view of an exemplary collapsible support with a six-pointed star shaped hole having different proportions than the six-pointed star of FIG. 35, according to an embodiment of the present invention.
Figure 37:
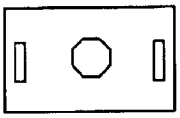
FIG. 37 is a schematic diagram showing a top view of an exemplary collapsible support with an octagonal hole, according to an embodiment of the present invention.
Figure 38:
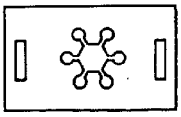
FIG. 38 is a schematic diagram showing a top view of an exemplary collapsible support with a hole having the shape of an asterisk, according to an embodiment of the present invention.

FIGS. 19–38 show various different types, shapes, and arrangements of holes that can be provided on embodiments of collapsible supports. FIG. 19 shows a centered, round hole. FIG. 20 shows a round hole that is located horizontally centered, but vertically off-center. FIG. 21 shows two centered, round holes. FIG. 22 shows two horizontally centered holes that are vertically off-center. FIG. 23 shows a centered racetrack shaped hole. FIG. 24 shows a racetrack shaped hold hole that is vertically off-center. FIG. 25 shows a centered rectangular hole. FIG. 26 shows a centered rectangular hole that has a major axis (the longer side) that is perpendicular to the major axis of the collapsible support. FIG. 27 shows a centered square hole. FIG. 28 shows an oval hole that is vertically off-center. FIG. 29 shows a centered diamond shaped hole. FIG. 30 shows a centered, diamond shaped hole with a major axis perpendicular to the major axis of the collapsible support. FIG. 31 shows a cross-shaped hole that is obliquely disposed relative to the collapsible support. FIG. 32 shows a cross-shaped hole that is normally disposed to the collapsible support. FIG. 33 shows a puffy cross-shaped or clover shaped hole obliquely disposed relative to the collapsible support. FIG. 34 shows a puffy cross-shaped or clover shaped hole normally disposed relative to the collapsible support. FIG. 35 shows a six-pointed star shaped hole. FIG. 36 shows a six-pointed star shaped hole having different proportions than the six-pointed star of FIG. 35. FIG. 37 shows a hole having the shape of an octagon. FIG. 38 shows a hole having the shape of an asterisk.

More than one hole can be used on a single collapsible support and different shapes of holes can exist on a single collapsible support. Clearly, different designs, shapes, sizes, and numbers of holes can be used than those disclosed.

FIG. 20 shows an embodiment that is similar to FIGS. 1–15. That embodiment will be used to demonstrate structural principles of the hole. Referring to FIG. 2, hole 2004 is formed in base 102. First leg 104 includes a first void 2006 and second leg 106 includes a second void 2008. Preferably, first and second voids 2006 and 2008 correspond with hole 2004 so that a continuous aperture 2010, as shown in FIG. 1, is formed through collapsible support 100 when collapsible support 100 is in the collapsed or stored condition. In other words, first and second voids 2006 and 2008 are designed to align with hole 2004 in base 102. This alignment helps to form continuous aperture 2010. In some embodiments, a portion of the inner surface of hole 2004 aligns with a surface of first void 2006 and another portion of the inner surface of hole 2004 aligns with a surface of second void 2008.

These principles can be applied to other shapes. Preferably, the shape is formed as an aperture in a base and corresponding voids are formed on one or both of the legs so that a continuous aperture through the entire collapsible support is formed when the collapsible support is in the collapsed or stored position.

The foregoing disclosure of the preferred embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A collapsible support comprising:

a base including a first end and a second end, the first end comprising a first side portion and the second end comprising a second side portion, a cavity formed between the first side portion and the second side portion, the first side portion having projecting members defining a slot, the base defining a base hole adjacent to the slot, the base having a projecting base tenon disposed adjacent to the base hole on a side of the base hole opposite the slot, and the projecting base tenon and the base hole having a substantially similar size and shape; and a first leg disposed within the cavity during a collapsed position, the first leg including a lateral tenon disposed on an upper end of the first leg, the lateral tenon and the slot having a substantially similar size and shape, the first leg having a projecting leg tenon adjacent to the lateral tenon, the first leg defining a leg hole disposed adjacent to the projecting leg tenon on a side of the projecting leg tenon opposite the lateral tenon, and the projecting leg tenon being substantially similar in size and shape to the leg hole, the base hole, and the projecting base tenon.

2. The collapsible support according to claim 1, further comprising a second leg disposed within the cavity during a collapsed position, the second side portion of the base having second projecting members defining a second slot, the base defining a second base hole adjacent to the second slot, the base having a second projecting base tenon disposed adjacent to the second base hole on a side of the second base hole opposite the second slot, the second projecting base tenon and the second base hole having a substantially similar size and shape, the second leg including a second lateral tenon disposed on an upper end of the second leg, the second lateral tenon and the second slot having a substantially similar size and shape, the second leg, having a second protecting leg, tenon adjacent to the second lateral tenon, the second leg defining a second leg hole disposed adjacent to the second projecting leg tenon on a side of the second projecting leg tenon opposite the second lateral tenon, and the second projecting leg tenon being substantially similar in size and shape to the second leg hole, the second base hole, and the second projecting base tenon.

3. The collapsible support according to claim 1, further comprising at least one substantially smooth surface while the collapsible support is in the collapsed position.

4. The collapsible support according to claim 1, wherein every exterior surface is substantially smooth while the collapsible support is in the collapsed position.

5. The collapsible support of claim 1, wherein, when the first leg is disposed within the cavity during a collapsed position, the lateral tenon is disposed in the slot and the projecting leg tenon is disposed in the base hole.

6. The collapsible support according to claim 1, wherein projecting leg tenon extends in a direction approximately normal to the lateral tenon of the first leg.

7. A collapsible support comprising:

a base comprising a first end and a second end the base defining a base hole proximate to the first end, the base having a projecting base tenon disposed adjacent to the base hole on a side of the base hole opposite the first end; and a first leg having a first surface and a second surface, the first leg having a lateral tenon extending from an upper end of the first leg, the first leg having a projecting leg tenon adjacent to the lateral tenon, the first leg defining a leg hole disposed adjacent to the projecting leg ten on a side of the projecting leg tenon opposite the lateral tenon, wherein, in a collapsed position, the first surface of the first leg faces the base, the projecting leg tenon engages the base hole, and the projecting base tenon engages the leg hole, and wherein, in a deployed position, the first surface of the first leg faces outward, the lateral tenon engages the base hole, and the upper end of the first leg faces the base.

8. The collapsible support of claim 7, further comprising a second leg having a first surface and a second surface, the base defining a second base hole proximate to the second end, the base having a second projecting base tenon disposed adjacent to the second base hole on a side of the second base hole opposite the second end, the second leg having a second lateral tenon extending from an upper end of the second the second leg having a second projecting leg tenon adjacent to the second lateral tenon, the second leg defining a second leg hole disposed adjacent to the second projecting leg tenon on a side of the second projecting leg tenon opposite the second lateral tenon, wherein, in a collapsed position, the first surface of the second leg faces the base, the second protecting leg tenon engages the second base hole, and the second projecting base tenon engages the second leg hole, and wherein, in a deployed position, the first surface of the second leg faces outwards, the second lateral tenon engages the second base hole, and the upper end of the second leg faces the base.

9. The collapsible support of claim 8, the second end comprising a second side portion, the second side portion having projecting members defining a slot, wherein, in the collapsed position, the second lateral tenon engages the slot, and wherein, in the deployed position, the upper end of the second leg is received in a region disposed between the second projecting base tenon and the projecting members of the second side portion.

10. The collapsible support of claim 7, the projecting leg tenon being substantially similar in size and shape to the hole, the projecting base tenon being substantially similar in size and shape to the leg hole, and the lateral tenon being substantially similar in size and shape to the base hole.

11. The collapsible support of claim 7, the first end comprising a first side portion, the first portion having a projecting members defining a slot, and wherein, in a collapsed position, the lateral tenon engages the slot.

12. The collapsible support of claim 11, wherein, in the deployed position, the upper end of the first leg is received in a region disposed between the projecting base tenon and the projecting members of the first side portion.

* * * * *